US009862530B2

(12) United States Patent
Sauey

(10) Patent No.: US 9,862,530 B2
(45) Date of Patent: Jan. 9, 2018

(54) STRAP DEVICE WITH MULTI-DIRECTIONAL STRAP BUCKLE

(71) Applicant: Carl Sauey, Tempe, AZ (US)

(72) Inventor: Carl Sauey, Tempe, AZ (US)

( * ) Notice: Subject to any disclaimer, the term of this patent is extended or adjusted under 35 U.S.C. 154(b) by 0 days.

(21) Appl. No.: 15/167,753

(22) Filed: May 27, 2016

(65) Prior Publication Data

US 2017/0341835 A1 Nov. 30, 2017

(51) Int. Cl.
*B65D 63/16* (2006.01)
*A44B 11/12* (2006.01)
*A44B 11/16* (2006.01)

(52) U.S. Cl.
CPC ..... *B65D 63/16* (2013.01); *A44B 11/12* (2013.01); *A44B 11/16* (2013.01)

(58) Field of Classification Search
CPC ..... B65D 63/16; A44B 11/12; A44B 11/16; A44B 11/006; A44B 11/2592; A44B 11/2596; A44B 11/266; Y10T 24/40; Y10T 24/45984
See application file for complete search history.

(56) References Cited

U.S. PATENT DOCUMENTS 379,374 A * 3/1888 Day ..... A41F 3/00 2/328
4,793,032 A * 12/1988 Crowle ..... A44B 11/266 24/607
5,438,737 A * 8/1995 Anscher ..... A44B 11/2549 24/615
5,440,790 A * 8/1995 Chou ..... B60P 7/0823 24/302
5,604,964 A * 2/1997 Aoshima ..... A44B 11/2515 24/632
5,709,014 A * 1/1998 Takahashi ..... A44B 11/2511 24/614
6,061,883 A * 5/2000 Uehara ..... A44B 11/263 24/615
6,711,790 B2 * 3/2004 Pontaoe ..... A44B 11/2549 24/633
7,803,176 B2 * 9/2010 Teague ..... A61B 17/8076 24/309
8,444,101 B2 * 5/2013 Holman ..... B65D 25/22 24/68 CD
2008/0010786 A1 * 1/2008 Huang ..... A44B 11/12 24/170

(Continued)

*Primary Examiner* — Robert Sandy
*Assistant Examiner* — David M Upchurch
(74) *Attorney, Agent, or Firm* — Parsons & Goltry; Robert a. Parsons; Michael W. Goltry

(57) ABSTRACT

A multi-directional strap device includes a base having a first end and an opposing second end angled with respect to the first end. A first clamping member is carried by the base proximate the first end of the base and movable between a clamped position and an unclamped position. A second clamping member is carried by the base proximate the second end of the base, and movable between a clamped position and an unclamped position, wherein the second clamping member is in series with the first clamping member and angled with respect thereto. A diverter member is carried by the base intermediate the first clamping member and the second clamping member. A strap is provided having an end coupled to the first end of the base and a free end.

15 Claims, 4 Drawing Sheets

(56) References Cited

U.S. PATENT DOCUMENTS

| | | | | |
|---|---|---|---|---|
| 2008/0148529 | A1* | 6/2008 | Huang | A44B 11/14 24/170 |
| 2010/0137112 | A1* | 6/2010 | Harker | A63B 21/0552 482/92 |
| 2010/0285939 | A1* | 11/2010 | Latronica | A63B 21/16 482/139 |
| 2013/0014707 | A1* | 1/2013 | Fidrych | A01K 27/005 119/863 |
| 2015/0016916 | A1* | 1/2015 | Dickey | B60P 7/08 410/100 |
| 2015/0135483 | A1* | 5/2015 | Grimm | A44B 11/006 24/163 R |

* cited by examiner

STRAP DEVICE WITH MULTI-DIRECTIONAL STRAP BUCKLE

FIELD OF THE INVENTION

This invention relates to strapping devices.

More particularly, the present invention relates to buckles and straps for bundling articles, packages and the like, and for use as tie-down straps.

BACKGROUND OF THE INVENTION

The use of strapping devices is common in many industries as well as simple everyday use by individuals. Straps are used to bundle items, secure packages and tie-down cargo, equipment and the like. Straps on packaging for consumer goods are typically one use disposable straps having ends that are glued, heat bonded or otherwise adhered together. Once removed, they are typically discarded.

Of more interest, are reusable straps used to secure loads, tie-down items or equipment, secure a package or carton, and the like. Reusable straps typically include a strap of webbing material having a free end and an end attached to a buckle of some sort. Often the buckle is a camming buckle which will releasably hold the free end of the webbing. The strap is wrapped about the articles or package with the free end received by the buckle. With elongated items such as pipes, rods, etc. the straps can be wrapped transverse to the longitudinal axis of the item being bundled for secure bundling. However, for more polygonal shaped or irregular shaped items, multiple sides may need to be retained. In this case, multiple crossing straps are often required. While somewhat effective, use of multiple straps with their multiple buckles can be difficult to adjust and access due to overlap.

In the field of cargo or package transport, tie-down straps are often used to prevent movement and shifting of the cargo during transport. Tie-down straps typically include a strap of webbing material having a free end and an end attached to a buckle of some sort. Often the buckle is a camming buckle which will releasably hold the free end of the webbing strap. Tie down straps are very similar to, and for purposes of this specification, considered strap devices. Tie-down straps typically include a ratchet device for tightening straps about cargo or equipment. As with bundling straps, many items require straps on multiple sides. This in turn requires multiple crossing tie-down straps. Again, while somewhat effective, use of multiple straps with their multiple buckles can be difficult to adjust and access due to overlap.

It would be highly advantageous, therefore, to remedy the foregoing and other deficiencies inherent in the prior art.

An object of the present invention is to provide a multi-direction strap buckle.

Another object of the present invention is to provide a strap device having a buckle allowing for wrapping of multiple sides of an article with a single strap.

SUMMARY OF THE INVENTION

Briefly, to achieve the desired objects and advantages of the instant invention provided is a multi-directional buckle for a strap device. The multi-direction buckle includes a base having a first end and an opposing second end angled with respect to the first end. A first clamping member is carried by the base proximate the first end of the base and movable between a clamped position and an unclamped position. A second clamping member is carried by the base proximate the second end of the base, and movable between a clamped position and an unclamped position, wherein the second clamping member is in series with the first clamping member and angled with respect thereto. A diverter member is carried by the base intermediate the first clamping member and the second clamping member.

The base can include a first sidewall having a corner formed intermediate a first end and a second end thereof, and a second sidewall having a corner corresponding to the corner of the first sidewall, formed intermediate a first end and a second end thereof. The second sidewall is spaced apart in a parallel relationship with the first sidewall.

In a further aspect, an anchor bar extends between the first sidewall and the second sidewall at the first end of the base. A first bar extends between the first sidewall and the second sidewall spaced downstream of the anchor bar. The first bar has an engagement surface facing upstream and adjacent an engagement end of the first clamping member in the clamped position. A second bar extends between the first sidewall and the second sidewall at the second end of the base. The second bar has an engagement surface facing upstream and adjacent an engagement end of the second clamping member in the clamped position.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the drawings, in which.

DETAILED DESCRIPTION OF THE PREFERRED EMBODIMENTS

Figure 1:
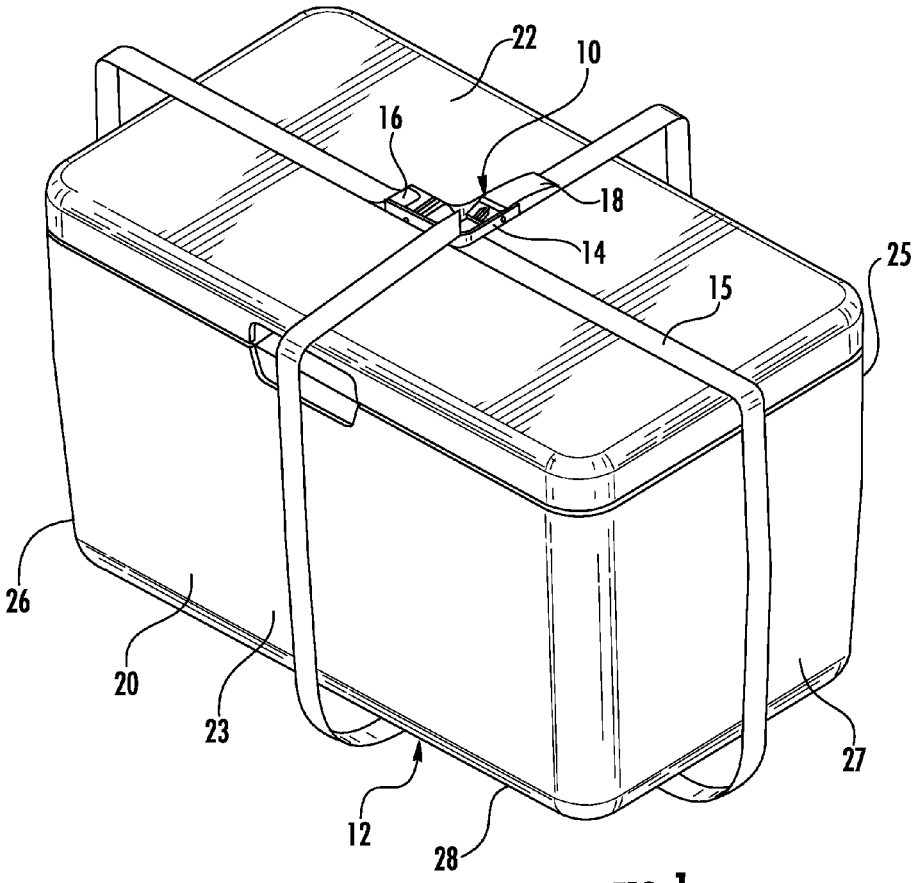
FIG. 1 is a perspective view of a multi-directional strap device according to the present invention, as it would appear wrapped around a container.

Turning now to the drawings in which like reference characters indicate corresponding elements throughout the several views, attention is first directed to FIG. 1 which illustrate a multi-directional strap device generally designated 10. Multi-directional strap device 10 is shown as it would appear wrapped around an article 12. Multi-directional strap device 10 includes a multi-directional buckle assembly 14 and a strap 15, having an attached end 16 and a free end 18. As can be seen in FIG. 1, a single multi-directional strap device 10 can be employed to secure opposing side pairs wherein each side pair is at an angle with respect to the adjacent side pair. In the present embodiment, article 12 is a container 20 having a cover 22. Container 20 and cover 22 are generally a cubic shape having opposing side walls 23, 25 (opposing side pairs), opposing end walls 26, 27 (adjacent opposing side pair) generally perpendicular to side walls 23, 25, and bottom 28. While article 12 is shown as a container 20 with cover 22 in the present embodiment, it will be understood that multi-directional strap device 10 can be used to strap substantially any packaging, stacks of materials and the like, which needs engagement of a strap on multiple sides. Other polygonal shapes can be strapped with multi-directional strap device 12 and the device is not limited to quadrilateral shapes. Additionally, while polygonal shapes are best, since the strap can engage flat surfaces, rounded or irregular shaped objects or stacks of items can also be strapped by wrapping two sets of opposing side pairs of the item with strap 15 in two separate directions. In other words, strap 15 will cross itself at multi-directional buckle assembly 14.

Figure 2:
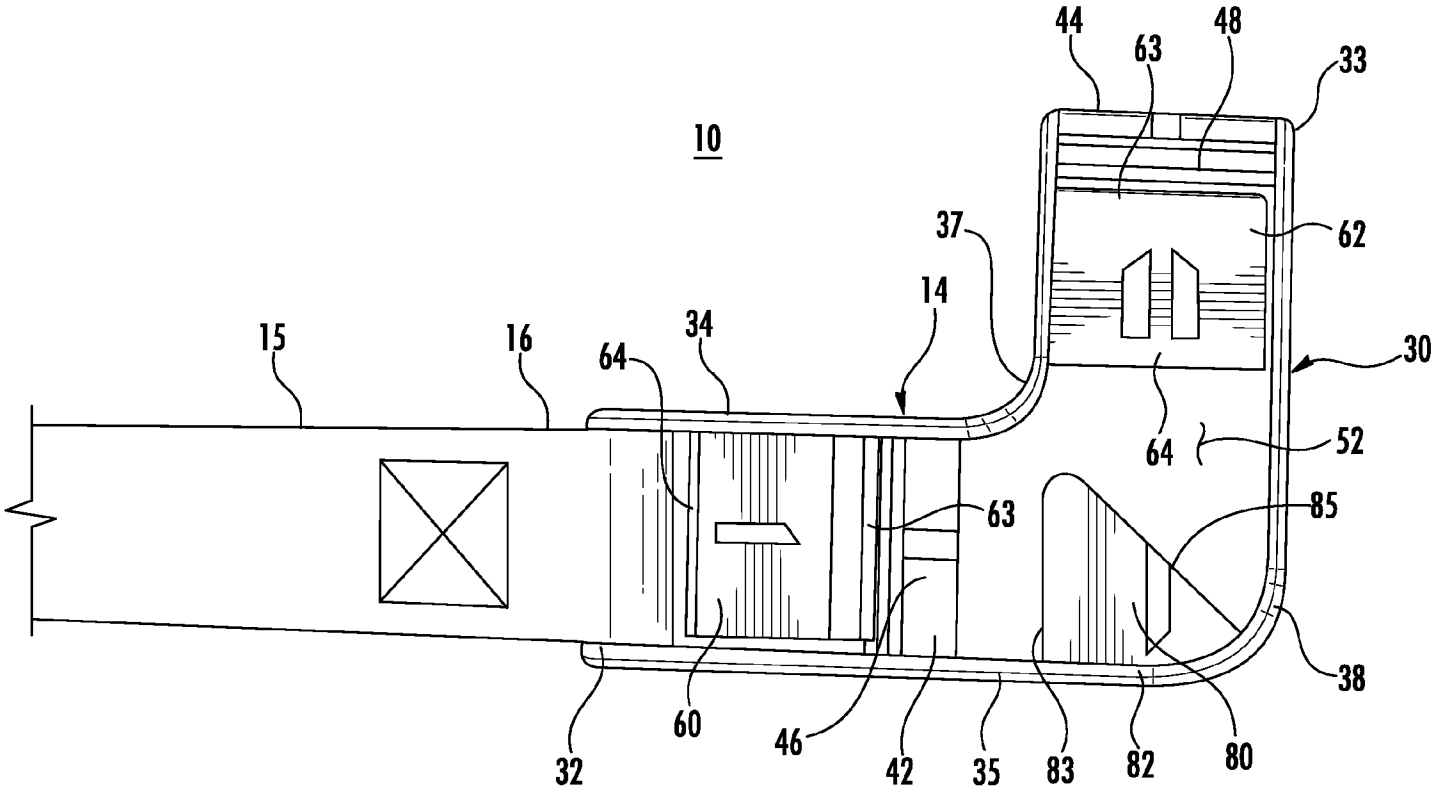
FIG. 2 is a top plan view of the multi-directional strap buckle and partial strap of the multi-directional strap device.
Figure 3:
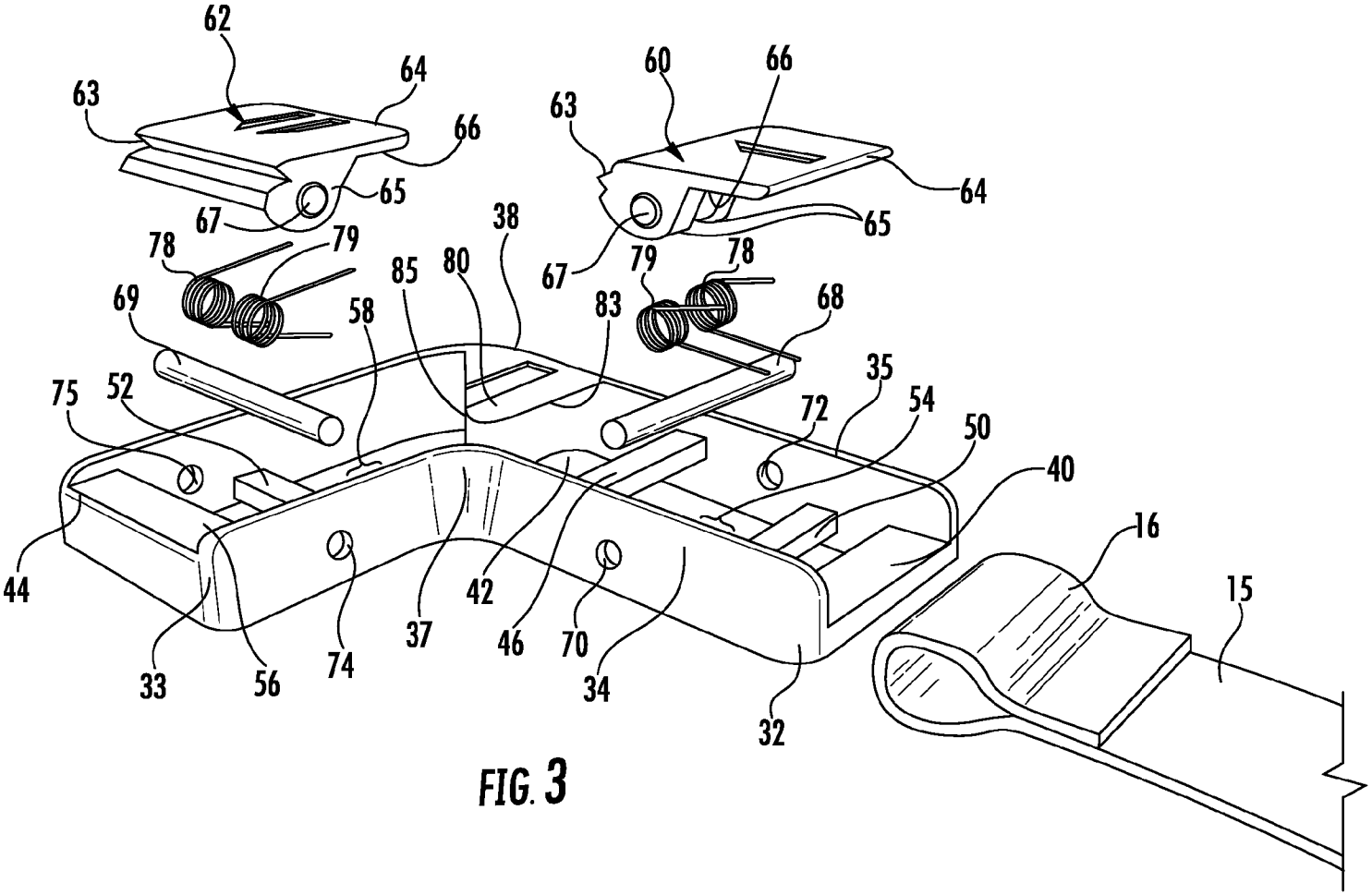
FIG. 3 is an exploded perspective view of the multi-directional strap buckle and strap of FIG. 2.

Referring now to FIGS. 2 and 3, multi-directional buckle assembly 14 includes a base 30 having an end 32 and an end 33 angled with respect to end 32. For purposes of orientation in this description, end 32 will be considered upstream and end 33 will be considered downstream. Base 30 is preferably formed with sidewalls 34 and 35 spaced apart in a parallel relationship. Sidewalls 34 and 35 bend at an angle intermediate end 32 and end 33 so as to form an inner corner 37 and an outer corner 38. Corners 37 and 38 are preferably right angles, but one skilled in the art will understand that a lesser or greater angle can be employed as long as end 32 and 33 are angled with respect to one another to permit crossing of strap 15 during use, as will be described presently. Additionally, while inner corner 37 and outer corner 38 can be formed as defined (sharp) angles, in the preferred embodiment the corners are radiused.

Base 30 further includes an anchor bar 40 extending between sidewalls 34 and 35 at end 32, a bar 42 extending between sidewalls 34 and 35 intermediate end 32 and inner corner 37, and a bar 44 extending between sidewalls 34 and 35 at end 33. Bars 42 and 44 include engagement surfaces 46 and 48, respectively facing upstream. Anchor bar 40, bar 42 and bar 44 also hold sidewalls 34 and 35 together. Additional strengthening cross-pieces 50 and 52 are provided proximate a bottom side 53 of base 30 extending between sidewalls 34 and 35. Cross-piece 50 is positioned proximate anchor bar 40 and cross-piece 52 is positioned intermediate bar 44 and inner corner 27. Cross-piece 50 defines a gap 54 between cross-piece 50 and bar 42, and cross-piece 52 defines a gap 56 between cross-piece 52 and bar 44 and another gap 58 between cross-piece 52 and bar 42.

Still referring to FIGS. 2 and 3 multi-directional buckle assembly 14 further includes clamping member 60 and 62 each having an engagement end 63, a lever end 64, a bracket 65 extending from a bottom 66 thereof, and aligned apertures 67 formed through bracket 65. In this preferred embodiment, brackets 65 are trifurcated, but can also be bifurcated or have no furcations. Clamping members 60 and 62 are carried within gap 54 and gap 56, respectively. A pin 68 extends concurrently through apertures 70 and 72 formed in sidewalls 34 and 35 in gap 54, and apertures 67 in clamping member 60. A pin 69 extends concurrently through apertures 74 and 75 formed in sidewalls 34 and 35 in gap 56, and apertures 67 in clamping member 62. Clamping members 60 and 62 are movable between a clamped position, wherein engagement ends 63 are positioned proximate engagement surfaces 46 and 48, respectively, and an unclamped position wherein engagement ends 63 are spaced apart from engagement surfaces 46 and 48, respectively. Bias members 78 and 79 are associated with each clamping member 60 and 62, and bias clamping members 60 and 62 into the clamp position. In this preferred embodiment, bias members 78 and 79 are torsion springs captured between the furcations of brackets 65 of each clamping member 60 and 62, and compressed between lever end 64 and cross-pieces 50 and 52. While two bias members are used for each clamping member 60 and 62 in the preferred embodiment, if bifurcated brackets are employed, a single biasing member will be captured between furcations. Clamping members 60 and 62 are both positioned with engagement ends 63 directed downstream. Thus, clamping members 60 and 62 are carried in series, preferably on a common plane, by base 30 and offset at an angle determined by corners 37 and 38.

Multi-directional buckle assembly 14 also includes a diverter member 80 carried within gap 52 and extending from sidewall 35 proximate outer corner 38. In the preferred embodiment, diverter member 80 has the shape of a right triangle with a base side 82 coextensive with sidewall 35 proximate outer corner 38. A side 83, perpendicular to base side 82, is parallel to and spaced apart from bar 42, and angled side 85 faces toward end 33. While diverter member 80 is a right triangle in the preferred embodiment, it will be understood that other structures and shapes can be employed to divert the strap to form a second loop at an angle to the first loop. For example, a pin, rod or bar can extend between sidewalls 34 and 35 at inner corner 37 and outer corner 38 to form a surface similar to side 85.

Figure 4:
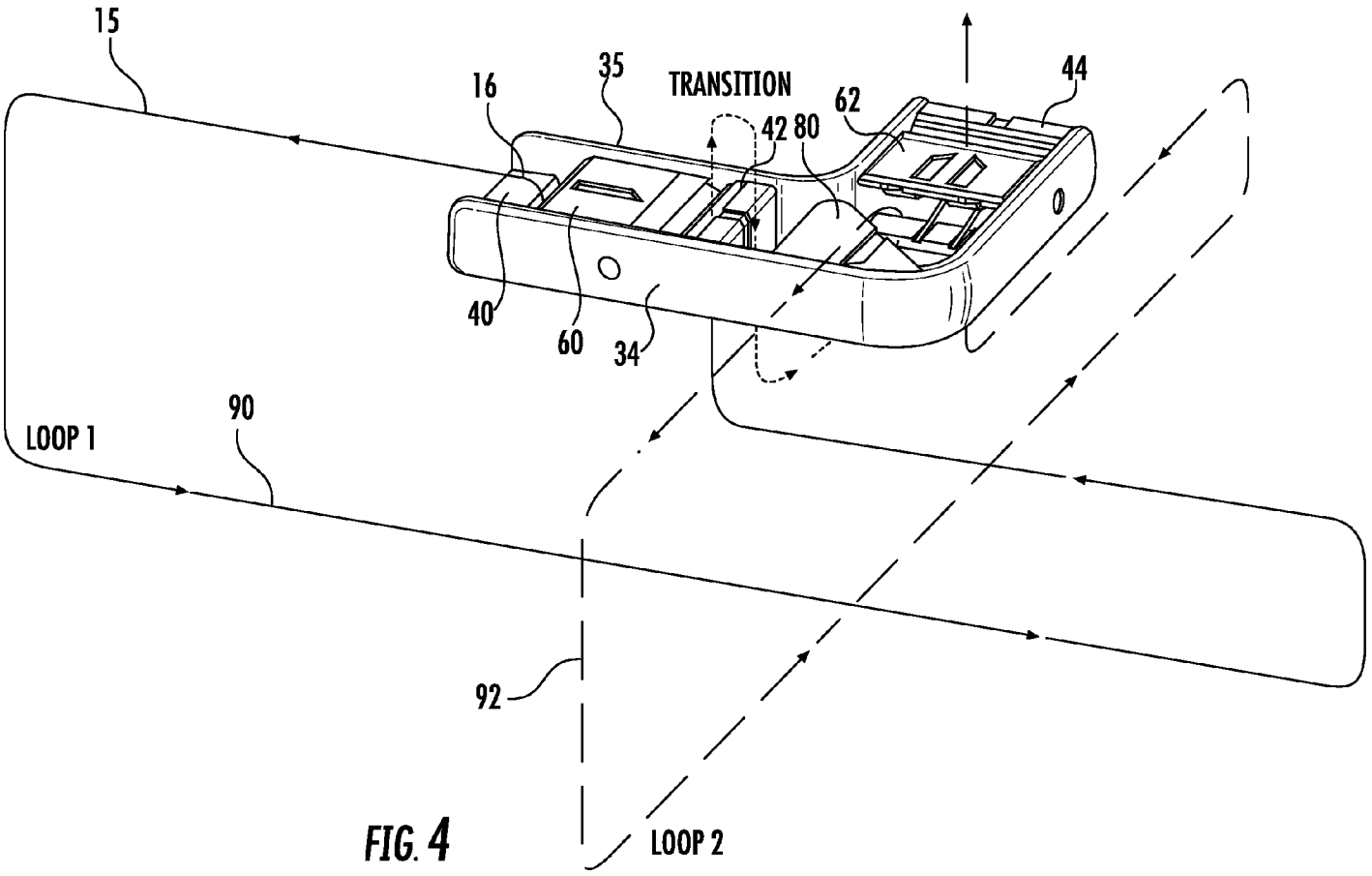
FIG. 4 is a perspective view of the multi-directional strap device with a diagrammatic illustration of the strap in use.

When employed to strap an article or articles, multi-directional strap device 10 can be employed to form two crossing loops. Referring to FIG. 4, strap 15 is indicated by a solid arrowed line for first loop 90 and a broken arrowed line for second loop 92. Attached end 16 of strap 15 is attached to anchor bar 40 and extends therefrom to form first loop 90 about the article to be strapped. Free end 18 of strap 15 is then passed upwardly through gap 54 between engagement surface 46 and engagement end 63 of clamping member 60. Clamping member 60 is moved to the unclamped position against the bias by pressing on lever end 64, allowing passage of strap 15 therebetween. Once loop 90 is sufficient tightened, clamping member 60 is biased back into the clamped position, securely holding strap 15 and preventing it from backing back through gap 54. At this point, the direction of strap 15 is transitioned by looping it over bar 42, down through gap 58 under diverter 80, then back up through gap 58 and outwardly from sidewall 35. Strap 15 engages and is diverted at an angle to first loop 90 by angled side 85, beginning second loop 92. Strap 15 is passed around the article to be strapped, crossing first loop 90 at an angle. Free end 18 of strap 15 is then passed upwardly through gap 56 between engagement surface 48 and engagement end 63 of clamping member 62. Clamping member 62 is moved to the unclamped position against the bias by pressing on lever end 64, allowing passage of strap 15 therebetween. Once loop 92 is sufficient tightened, clamping member 62 is biased back into the clamped position, securely holding strap 15 and preventing it from backing back through gap 56.

Various changes and modifications to the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

1. A multi-directional buckle comprising:

a base having a first end and an opposing second end angled with respect to the first end;

a first clamping member carried by the base proximate the first end of the base, and movable between a clamped position and an unclamped position, the first clamping member including an engagement end directed in a downstream direction;

a second clamping member carried by the base proximate the second end of the base, and movable between a clamped position and an unclamped position, the second clamping member including an engagement end directed in the downstream direction, wherein the second clamping member is in series with the first clamping member and angled with respect thereto; and a diverter member carried by the base intermediate the first clamping member and the second clamping member.

2. A multi-directional buckle as claimed in claim 1 wherein the base comprises:

a first sidewall having a corner formed intermediate a first end and a second end thereof; and a second sidewall having a corner corresponding to the corner of the first sidewall, formed intermediate a first end and a second end thereof, the second sidewall spaced apart in a parallel relationship with the first sidewall.

3. A multi-directional buckle as claimed in claim 2 wherein the base further comprises:

an anchor bar extending between the first sidewall and the second sidewall at the first end of the base;

a first bar extending between the first sidewall and the second sidewall spaced downstream of the anchor bar, the first bar having an engagement surface facing upstream and adjacent an engagement end of the first clamping member in the clamped position;

a second bar extending between the first sidewall and the second sidewall at the second end of the base, the second bar having an engagement surface facing upstream and adjacent an engagement end of the second clamping member in the clamped position.

4. A multi-directional buckle as claimed in claim 3 wherein the base further comprises:

a first gap defined between the anchor bar and the first bar;

the first clamping member pivotally carried within the first gap;

a second gap defined between the second bar and the diverter member; and the second clamping member pivotally carried within the second gap.

5. A multi-directional buckle as claimed in claim 4 wherein the first clamping member and the second clamping member are biased into the clamp position.

6. A multi-directional buckle as claimed in claim 3 further including a strap having an end coupled to the anchor bar and a free end.

7. A multi-directional buckle as claimed in claim 5 wherein the biasing members are torsions springs.

8. A multi-directional buckle as claimed in claim 2 wherein the diverter member has the shape of a right triangle with a base side coextensive with the first sidewall proximate the corner thereof, a side perpendicular to the base side, parallel to and spaced apart from the first bar, and an angled side directed toward the second end.

9. A multi-directional strap device comprising:

a multidirectional buckle comprising:

a base having a first end and an opposing second end angled with respect to the first end;

a first clamping member carried by the base proximate the first end of the base, and movable between a clamped position and an unclamped position, the first clamping member including an engagement end directed in a downstream direction;

a second clamping member carried by the base proximate the second end of the base, and movable between a clamped position and an unclamped position, the second clamping member including an engagement end directed in the downstream direction wherein the second clamping member is in series with the first clamping member and angled with respect thereto; and a diverter member carried by the base intermediate the first clamping member and the second clamping member; and a strap having an end coupled to the first end of the base and a free end.

10. A multi-directional strap device as claimed in claim 9 wherein the base comprises:

a first sidewall having a corner formed intermediate a first end and a second end thereof; and a second sidewall having a corner corresponding to the corner of the first sidewall, formed intermediate a first end and a second end thereof, the second sidewall spaced apart in a parallel relationship with the first sidewall.

11. A multi-directional buckle as claimed in claim 10 wherein the base further comprises:

an anchor bar extending between the first sidewall and the second sidewall at the first end of the base, wherein the end of the strap is coupled to thereto;

a first bar extending between the first sidewall and the second sidewall spaced downstream of the anchor bar, the first bar having an engagement surface facing upstream and adjacent an engagement end of the first clamping member in the clamped position;

a second bar extending between the first sidewall and the second sidewall at the second end of the base, the second bar having an engagement surface facing upstream and adjacent an engagement end of the second clamping member in the clamped position.

12. A multi-directional buckle as claimed in claim 11 wherein the base further comprises:

a first gap defined between the anchor bar and the first bar;

the first clamping member pivotally carried within the first gap;

a second gap defined between the second bar and the diverter member; and the second clamping member pivotally carried within the second gap.

13. A multi-directional buckle as claimed in claim 12 wherein the first clamping member and the second clamping member are biased into the clamp position.

14. A multi-directional buckle as claimed in claim 13 wherein the biasing members are torsions springs.

15. A multi-directional buckle as claimed in claim 10 wherein the diverter member has the shape of a right triangle with a base side coextensive with the first sidewall proximate the corner thereof, a side perpendicular to the base side, parallel to and spaced apart from the first bar, and an angled side directed toward the second end.

* * * * *